US010753354B2

(12) United States Patent
Söderström et al.

(10) Patent No.: US 10,753,354 B2
(45) Date of Patent: Aug. 25, 2020

(54) PUMP SYSTEM

(71) Applicant: CAREBAY EUROPE LTD, Sliema (MT)

(72) Inventors: Michael Söderström, Djursholm (SE); Henrik Johansson, Uppsala (SE)

(73) Assignee: SHL Group AB, Zug (CH)

( * ) Notice: Subject to any disclaimer, the term of this patent is extended or adjusted under 35 U.S.C. 154(b) by 358 days.

(21) Appl. No.: 15/742,431

(22) PCT Filed: Jul. 18, 2016

(86) PCT No.: PCT/EP2016/067011
§ 371 (c)(1),
(2) Date: Jan. 5, 2018

(87) PCT Pub. No.: WO2017/025276
PCT Pub. Date: Feb. 16, 2017

(65) Prior Publication Data

US 2018/0195506 A1 Jul. 12, 2018

(30) Foreign Application Priority Data

Aug. 12, 2015 (SE) ..... 1551065

(51) Int. Cl.
*F04B 47/04* (2006.01)
*F04B 43/10* (2006.01)
(Continued)

(52) U.S. Cl.
CPC ..... *F04B 47/04* (2013.01); *E21B 43/121* (2013.01); *E21B 43/129* (2013.01);
(Continued)

(58) Field of Classification Search
CPC .... F04B 43/10; F04B 43/107; F04B 43/1133; F04B 43/113; F04B 43/0072; F04B 47/00;
(Continued)

(56) References Cited

U.S. PATENT DOCUMENTS 3,039,309 A * 6/1962 Vesper ..... F04B 43/1133 73/863.24
4,424,009 A 1/1984 van Os
(Continued)

FOREIGN PATENT DOCUMENTS

EP 1122435 A1 8/2001
GB 2054057 A 2/1981
(Continued)

OTHER PUBLICATIONS

International Search Report and Written Opinion for Int. App. No. PCT/EP2016/067011, dated Nov. 17, 2016.

*Primary Examiner* — Peter J Bertheaud
(74) *Attorney, Agent, or Firm* — McDonnell Boehnen Hulbert & Berghoff LLP

(57) ABSTRACT

A pump system is presented having a pump with a generally cylindrical pump housing that is arranged with a liquid inlet in one end and a liquid outlet in a second end. A tubular membrane is arranged inside the pump housing and a first passage is arranged in the vicinity of the liquid inlet for introducing pressurized fluid between the membrane and the housing. A second passage arranged in the vicinity of said liquid outlet for releasing said pressurized fluid where the membrane is arranged with an elasticity providing a local radial compression and an annular fluid compartment when a pulse of pressurized fluid is entered through the first passage. The annular fluid compartment travels along the housing bringing a volume of liquid with it. An expansion vessel can be operably attached to the liquid outlet for
(Continued)

reducing pressure changes in the liquid caused by the action of the pulse of pressurized fluid.

22 Claims, 4 Drawing Sheets

(51) Int. Cl.

| | |
|---|---|
| ***F04B 47/08*** | (2006.01) |
| ***F04B 43/113*** | (2006.01) |
| ***F04B 47/00*** | (2006.01) |
| ***E21B 43/12*** | (2006.01) |
| ***F04B 47/02*** | (2006.01) |
| ***F04B 43/00*** | (2006.01) |

(52) U.S. Cl.
CPC ..... *F04B 43/0072* (2013.01); *F04B 43/10* (2013.01); *F04B 43/113* (2013.01); *F04B 43/1133* (2013.01); *F04B 47/00* (2013.01); *F04B 47/02* (2013.01); *F04B 47/08* (2013.01)

(58) Field of Classification Search
CPC ..... F04B 47/02; F04B 47/04; F04B 47/06; F04B 47/08; E21B 43/121; E21B 43/129
See application file for complete search history.

(56) References Cited

U.S. PATENT DOCUMENTS

| | | | | |
|---|---|---|---|---|
| 4,515,536 A | | 5/1985 | van Os | |
| 4,580,952 A | * | 4/1986 | Eberle | F04B 47/04 417/383 |
| 4,802,829 A | * | 2/1989 | Miller | F04B 17/006 417/118 |
| 2015/0118068 A1 | * | 4/2015 | Strunk | F04B 47/02 417/63 |

FOREIGN PATENT DOCUMENTS

| | | |
|---|---|---|
| JP | H01-240777 | 9/1989 |
| JP | H03-149373 A | 6/1991 |
| SE | 520389 C2 | 7/2003 |

* cited by examiner

PUMP SYSTEM

CROSS REFERENCE TO RELATED APPLICATIONS

The present application is a U.S. National Phase Application pursuant to 35 U.S.C. § 371 of International Application No. PCT/EP2016/067011 filed Jul. 18, 2016, which claims priority to Swedish Patent Application No. 1551065-4 filed Aug. 12, 2015. The entire disclosure contents of these applications are herewith incorporated by reference into the present application.

TECHNICAL AREA

The present disclosure relates to a pump system for pumping liquids, and in particular a pump system where the pump can be submersed.

BACKGROUND

There are a number of pumps on the market that work with a principle of having a tube-shaped membrane inside a tubular housing that can be alternatively compressed and expanded by for example pressurized air in order to move a volume of liquid through the pump housing. Examples of such pumps are disclosed in EP 1122435, JP 01240777 and JP03149373.

The pump disclosed in EP 1122435 is quite complicated in its design with an elongated flexible tube that is placed inside a pipe and when inflated will act on material in the pipe. In order to push material along the length of the pipe, the tube is arranged with sections of increasing wall thickness along its length, whereby the section with the thinnest wall will be inflated first and then successively the sections with increasing wall thickness will be inflated in sequence.

The two other documents disclose a similar solution with an inner, flexible hose. Pressurised medium between elongated pipe sections and the flexible hose is controlled such that the hose will be inflated in a wave-like manner along the length of the sections, creating a movement of material inside the pipe sections in one transport direction.

A further pump solution utilizing the above mentioned principle is disclosed in document SE 520389C2. The pump comprises an elongated tube having a somewhat conical shape. Inside the tube a flexible hose is arranged along the length of the tube and attached at the ends. The tube is arranged with an air inlet and an air outlet. During use, pulses of compressed air are forced into the air inlet whereby the tube is radially compressed such that an annular space is created. The annular space moves along the length of the tube towards the air outlet, bringing liquid inside the hose with it. When the space reaches the air outlet, the compression terminates. At the same time, successive spaces are created by pulses of air entering through the air inlet.

A drawback with the solution according to SE 520389C2 is that the pulsed creation of the spaces in the pump and the successive and pulsed movement of volumes of liquid cause pulsed forces in the whole pump system that have negative effects on the performance of the pump. It would be a benefit if the effects of these forces where reduced in order to increase the capacity of the pump.

SUMMARY

The aim of the present disclosure is to provide a sturdy, simple, cost-effective and yet reliable pump system for pumping all sorts of liquids.

This aim is obtained by a pump system comprising the features of the independent patent claim.

Preferable embodiments of the disclosure form the subject of the dependent patent claims.

According to the disclosure, the pump system may comprise a pump having a generally cylindrical pump housing where the pump housing is arranged with a liquid inlet in one end and a liquid outlet in a second end. Preferably a tubular membrane is arranged inside said pump housing wherein a first passage is arranged in the vicinity of said liquid inlet for introducing pressurized fluid between said membrane and said housing, and a second passage arranged in the vicinity of the liquid outlet for releasing the pressurized fluid.

The membrane is arranged with an elasticity providing a local radial compression and an annular fluid compartment when a pulse of pressurized fluid is entered through the first passage, wherein the annular fluid compartment travels along the housing, bringing a volume of liquid with it.

According to a preferable solution, the system may further comprise an expansion vessel operably attached to said liquid outlet for reducing pressure changes in said liquid caused by the action of said pulse of pressurized fluid. In this manner the effects on the pumping function from the action of the annular fluid compartments with compressed air is greatly reduced in that the pulses that are created when the annular fluid compartments move in the pump are handled and dampened by the expansion vessel.

For best performance of the pump system during operation, the pump housing is positioned with said inlet generally vertically downwards and with said outlet generally vertically upwards. In that respect, the pump system may further comprise a conduit attached to said liquid outlet and being oriented generally vertically for creating a liquid column. The liquid column has an important function in pressing the membrane against the pump housing, eliminating leakage of fluid which otherwise would lead to reduced efficiency.

Thus, the length and diameter of said conduit may preferably be chosen such that a liquid column is created having a weight which creates a pressure on said membrane ensuring a tight seal between said membrane and an inner surface of said pump housing.

According to a further feature, an upper end of said conduit is arranged with a branch, wherein the expansion vessel is attached to one branch and a second branch constitutes an outlet for the liquid. A simple and yet effective solution for attaching an expansion vessel and providing an outlet connection for the pumped liquid is thereby obtained.

The system preferably also comprises a compressor capable of providing pulses of pressurized fluid to the pump housing, wherein the compressor may be operably connected to a power generator, e.g. photovoltaic panels, capable of energizing the compressor. It may also comprise at least one battery operably connected to the compressor and to the power generator. In this manner a very low-cost energy system for running the pump system is obtained.

In order to have a very efficient pump system, it may preferably further comprise a check valve in liquid communication with the inlet passage of the pump housing. In addition it may further comprise a filter unit arranged before said check valve as seen in the liquid direction.

According to one favourable solution, the check valve may comprise a generally tubular body provided with a number of passages, a generally tubular flexible membrane arranged coaxial with and inside the body having one end of the tubular membrane fixedly attached to the housing.

These and other aspects of, and advantages with, the present disclosure will become apparent from the following detailed description of the disclosure and from the accompanying drawings.

BRIEF DESCRIPTION OF DRAWINGS

In the following detailed description of the disclosure, reference will be made to the accompanying drawings, of which

DETAILED DESCRIPTION

Figure 1:
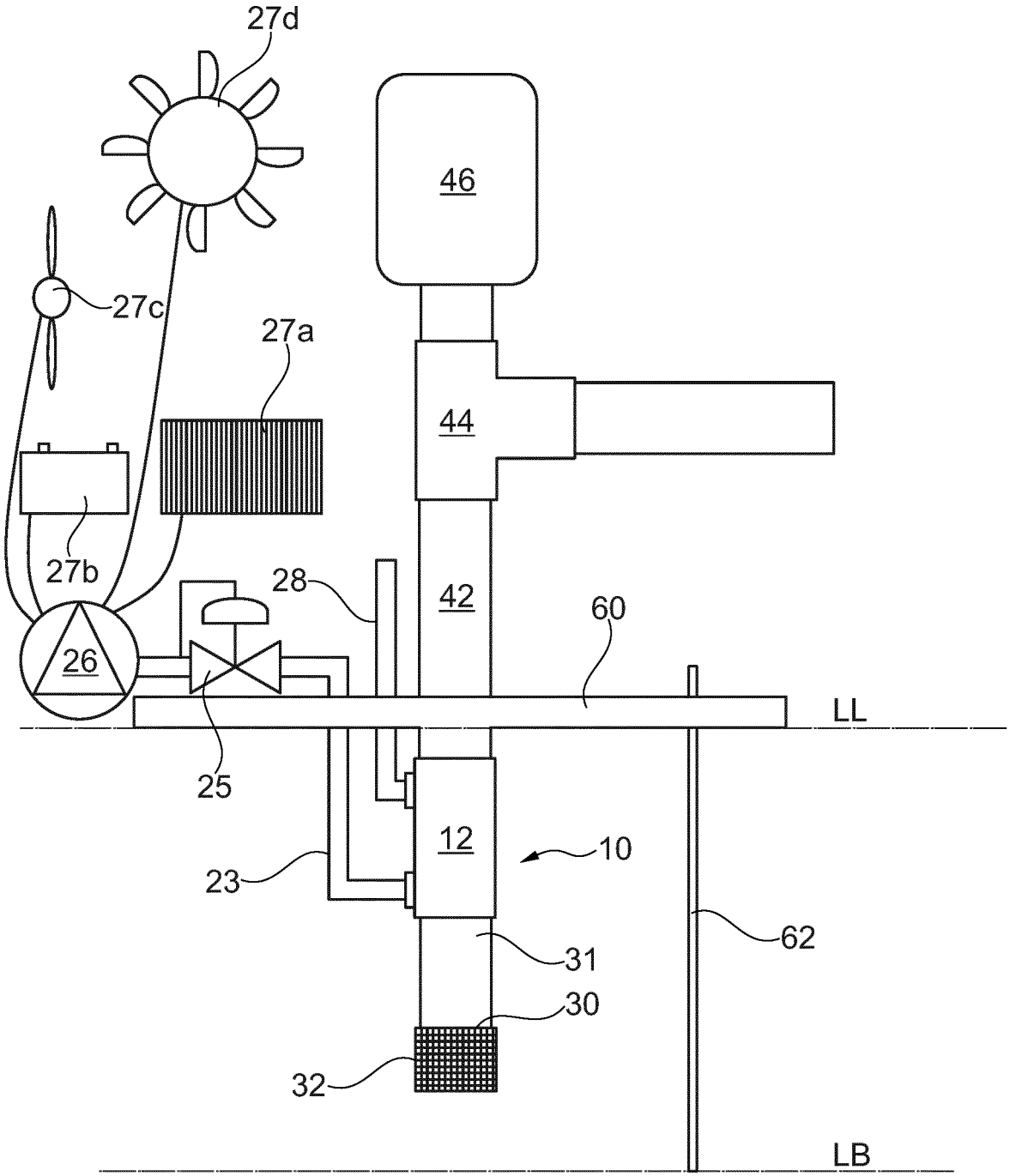
FIG. 1 is a schematic view of a pump system according to the disclosure.
Figure 2:
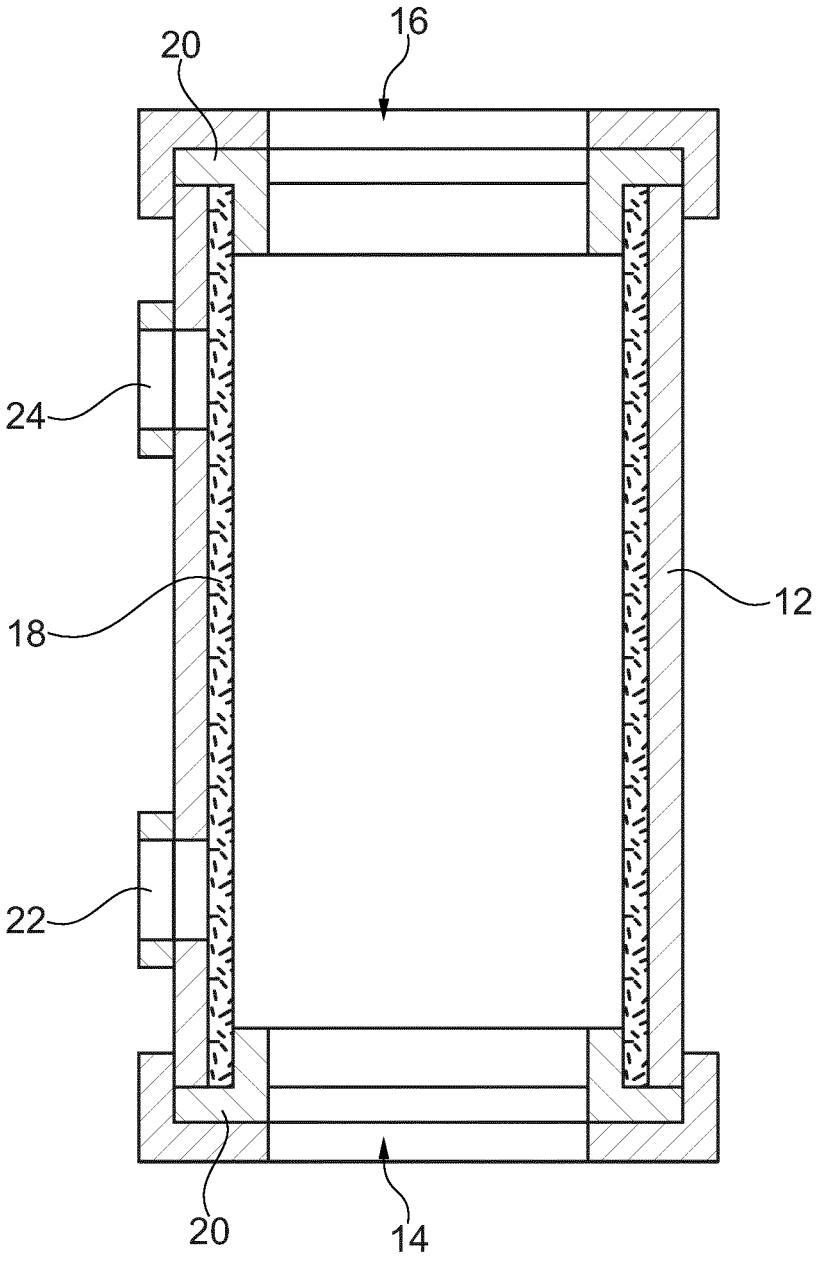
FIG. 2 is a cross-sectional view of a pump comprised in the pump system of FIG. 1.

The pump system that is described below comprises a pump 10 having generally tubular elongated pump housing 12 provided with passages at each end thereof, one inlet passage 14 and one outlet passage 16. The passages are arranged with suitable attachment elements for connecting suitable conduits to each passage. The attachment elements may comprise e.g. threads, bayonet fittings, quick couplings of garden hose type, just to mention a few.

The interior of the housing is arranged with a generally tubular flexible element or membrane 18 such as e.g. a rubber hose. It is however to be understood that other types of material, such as plastic, having the required properties may be utilized. The flexible element 18 has a shape and dimension so as to contact at least a major part of the inner surface of the housing 12 when placed inside the housing 12. The ends of the flexible element 18 are attached to the housing 12 at the inlet and outlet passages by appropriate attachment elements 20.

The housing 12 is further arranged with two passages 22, 24 on its side surface. Preferably the passages 22, 24 are arranged on the same side as seen in a circumferential direction, but this is not a requirement. An important factor is however that one passage 22 is closer to the inlet 14 than the other passage 24. Each passage is arranged with suitable attachment elements such as for example threads. The passage 22 closer to the inlet 14 is connected via a suitable conduit 23 to a suitable pressure source 26 that is capable of providing pulsated pressurised air, as will be explained. For instance, a compressor 26 may be used for creating pressurized air and a pulse generator 25 may be arranged between the compressor 26 and the passage 22 for the air. The pulse generator may for example be a pressure valve that opens above a certain pressure threshold and closes below said pressure threshold. However, there are many other types of pulse generators on the market that may be used, and which are known to the skilled person.

The compressor 26 is connected to a suitable power source which may be selected from various alternatives, depending on the pump application and on the available power. It may either be connected to a conventional mains power system, to photovoltaic panels 27*a*, batteries 27*b* and/or water or air driven power generators 27*c*, 27*d* respectively. If batteries are utilized, other power generators may be used for charging the batteries.

The outlet passage 24 for the air is arranged with a conduit 28 of a length such that it is ascertained that the outlet of the conduit 28 is well above the liquid level LL in which the pump is submersed. Preferably the conduit 28 is of a non-flexible material and should be dimensioned such that flow-resistance for the passing air is as low as possible.

The inlet 14 of the housing 12 is preferably attached to a check valve 30, either directly or via a suitable conduit 31. The check valve 30 may further be provided with a filter 32 for preventing objects and larger particles from entering the pump 10. The filter 32 may either be an ordinary mesh filter, possibly integrated with the check valve 30, or it may comprise a combined valve and filter where valve members are placed in the orifices of the filter 32. Since the pump 10 of the present disclosure can handle rather large objects having dimensions somewhat smaller than the inner diameter of the pump without being damaged, as will be described below, the orifices may be rather large.

Figure 3A:
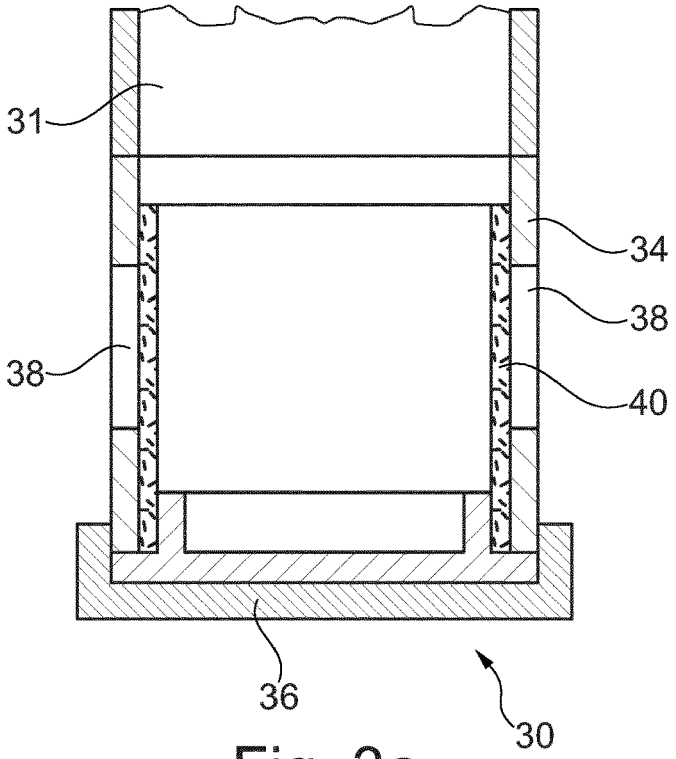
FIG. 3 is a cross-sectional view of a check valve that may be used with the pump system of FIG. 1.
Figure 3B:
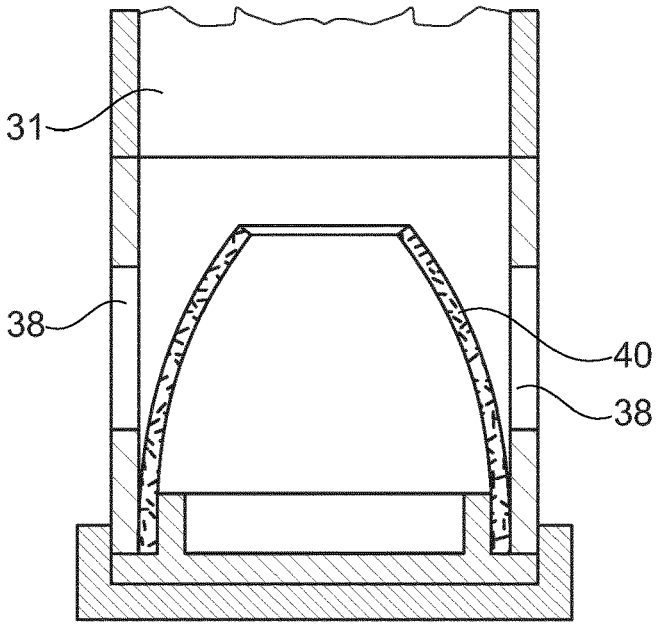

FIG. 3 shows one type of check valve having a generally tubular body 34 with one end in liquid communication with the pump 10. The other end is closed off by a lid or wall 36. Around the circumference of the body a number of passages 38 are arranged. Inside the body 34 a generally tube-shaped flexible membrane 40 is arranged having a shape and dimension so as to be in contact with the inner surface of the body 34. When the interior of the valve 30 is filled with liquid and the pump 10 is not active, the column of liquid in the pump system that is arranged above the valve 30 as seen in a vertical direction will press the membrane against the inner surface of the body, effectively closing the passages as seen in FIG. 3*a*. On the other hand, if the pump 10 is active and liquid is drawn by the pump 10, the flexible membrane 40 will flex inwards due to the suction action of the pump 10, FIG. 3*b*, thereby opening the passages 38 so that liquid may flow. The size of the passages 38 is chosen such that larger objects are prevented from entering.

The outlet passage 16 of the pump 10 is arranged with a conduit 42 of a certain length. The length is chosen such that a column of liquid of a certain weight is obtained. The weight is chosen such that it is ascertained that the membrane 18 is pressed against the inner surface of the pump housing 12. At the upper end of the conduit 42, a branch 44 may be arranged, such as a T-shaped connection. An expansion vessel 46 is attached to one of the connections, preferably the vertical connection as seen in FIG. 1. The function of the expansion vessel 46 is to handle the pressure peaks that are generated when the pump 10 is working in order to smooth out the pressure peaks against the pressure that is formed in the pump system during operation.

Regarding the conduits 31 and 42 on both sides of the pump, it might be advantageous to arrange these as modules with fixed lengths that are inter-connectable. In this manner, the pump may be modified to have a longer inlet for instance if the pump is to be placed in a drilled well. On the other hand, it might in some instances be advantageous to have the outlet longer in order to create a higher water column. Regarding drilled wells, the dimensions of the pump, including the attachments of the passages 22, 24 and the conduits, in the transversal direction may be chosen so as to fit in tubes of drilled wells.

If the pump is to be placed in a lake, pond or similar larger water areas, it might be arranged with some type of buoyancy element 60 such as a plate of floating material that is attached to the pump. The buoyancy element 60 may further be arranged with attachment functions such as through-holes, through which anchoring rods 62 may be placed and in turn attached to the lake bottom LB. attachment functions may also or instead include ropes and the like for holding the pump in place. The buoyancy element 60 may further function as a lid if the pump is used in a drilled or dug well.

Figure 4A:
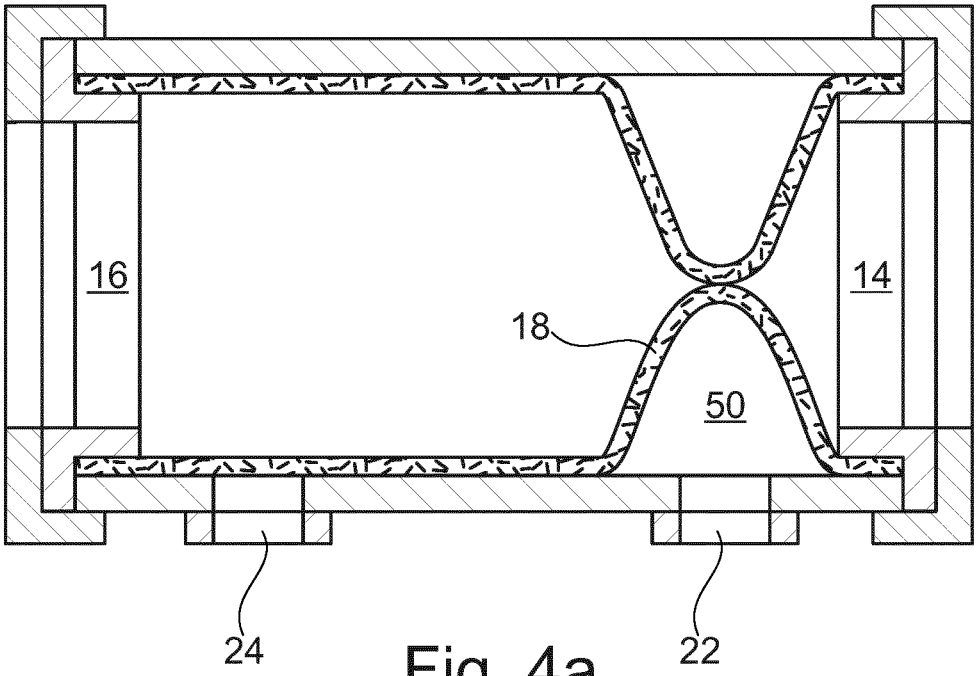
FIG. 4 is a cross-sectional view of the working principle of the pump of FIG. 2.
Figure 4B:
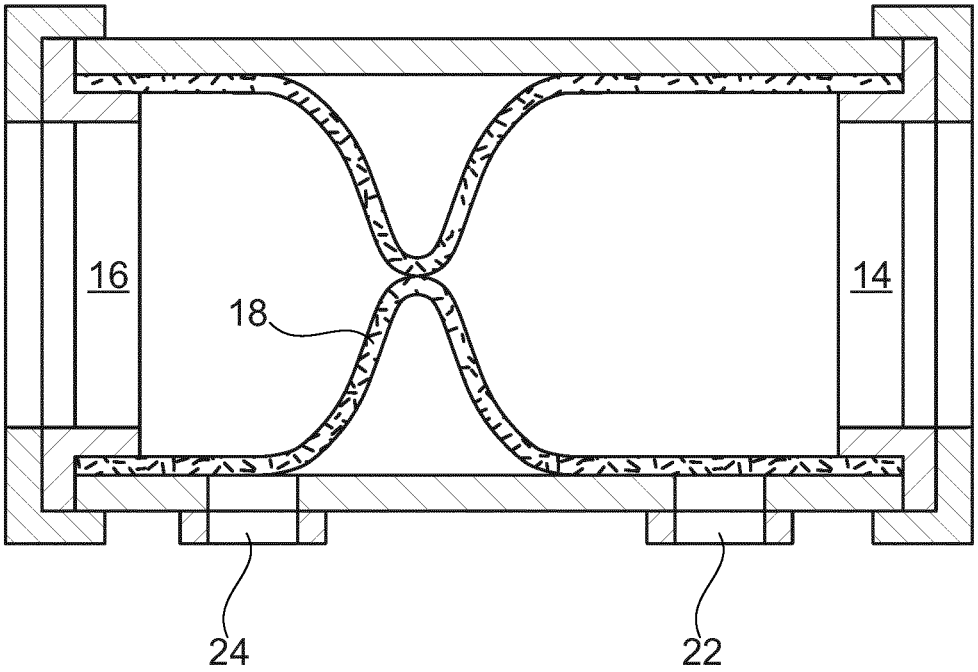

The pump system is intended to function as follows. The pump 10 is placed in the liquid to be pumped, preferably vertically with its inlet 14 downwards and its outlet 16 upwards. The pump 10 is placed at such a depth that the outlet passage of the conduit 28 for the compressed air is well above the liquid level. The compressor 26 is then activated whereby it delivers compressed air. In that regard, the compressor 26 might be driven by photovoltaic panels, providing an inexpensive operation in places where there is a lack of electric power. A pulse generator connected to the compressor generates a series of pulses of compressed air. Each pulse of compressed air presses the membrane 18 to be locally radially compressed, FIG. 4*a*. The pulse of air thus creates an annular fluid compartment 50 that is moving upwards between the membrane 18 and the housing 12 towards the outlet.

In order to ensure a pumping effect, i.e. creating the local annular fluid compartment 50, the membrane 18 has to be pressed against the inner surface of the housing 12 before each new air pulse. The force needed to press the membrane 18 against the housing 12 is created by the column of liquid that is created by the conduit 42 attached to the liquid outlet, whereby its weight will create the necessary force. It is to be understood that a longer conduit 42 will create a heavier liquid column that will more easily press the membrane 18 against the housing 12. However, if the weight is too large, that will affect the pumping capacity of the pump. Thus, if the weight increases, then the pressure of the air pulse also has to be increased. Further the liquid column also constitutes the transport of water out of the system.

The expansion vessel 46 will ensure that the effect of the air pulses are limited and that they are balanced against the pressure of the system as such, where the aim is to have the pump working with as small recoil forces as possible because each air pulse creates a downward movement inside the pump housing 12 when the membrane 18 is compressed and pushes the liquid upwards.

The check valve 30 at the inlet 14 has an important function because it prevents the liquid that is drawn into the pump 10 from flowing back between the air pulses. On the one hand, a normal check valve 30, possibly integrated with a mesh filter 32, may be used.

On the other hand, the simple and yet effective check valve describe above may be utilised for the function. Preferably the same type of tubular membrane is used in the check valve as in the pump. In this manner a very cost-effective solution is obtained. For instance, an ordinary bicycle hose, such as from a BMX-cycle, can be used both in the pump and in the check valve. The number and the size of the passages 38 in the body of the check-valve may be chosen depending on application.

It is to be understood that the embodiment described above and shown in the drawings is to be regarded only as a non-limiting example and that it may be modified in many ways within the scope of the patent claims.

The invention claimed is:

1. A pump system comprising:

a pump having a generally cylindrical pump housing, wherein the pump housing is arranged with a liquid inlet in a first end and a liquid outlet in a second end, and wherein the liquid inlet is oriented generally vertically downwards and the liquid outlet is oriented generally vertically upwards;

a tubular membrane arranged inside the pump housing;

a first passage arranged in a vicinity of the liquid inlet for introducing pressurized fluid between the tubular membrane and the housing, wherein the tubular membrane is arranged with an elasticity providing a local radial compression and a ring-shaped fluid compartment when a pulse of pressurized fluid is entered through the first passage, and wherein the ring-shaped fluid compartment travels along the housing bringing a volume of liquid with it;

a second passage arranged in a vicinity of the liquid outlet for releasing the pressurized fluid;

an expansion vessel operably attached to the liquid outlet for reducing pressure changes in the liquid caused by the action of the pulse of pressurized fluid; and a conduit attached to the liquid outlet and being oriented generally vertically for creating a liquid column, wherein an upper end of the conduit includes a first branch attached to the expansion vessel and a second branch that constitutes an outlet for the liquid.

2. The pump system according to claim 1, wherein a length of the conduit is chosen such that the liquid column is created having a weight creating a pressure on the tubular membrane ensuring a tight seal between the tubular membrane and an inner surface of the pump housing.

3. The pump system according to claim 1, further comprising a compressor operably connected to a pulse generator for providing pulses of pressurized fluid to the pump housing.

4. The pump system according to claim 3, wherein the pulse generator is a pressure valve that opens above a certain pressure threshold and closes below the pressure threshold.

5. The pump system according to claim 3, further comprising a power generator operably connected to the compressor, capable of energizing the compressor.

6. The pump system according to claim 5, wherein the power generator comprises one or several of photovoltaic panels, wind turbines, water turbines.

7. The pump system according to claim 5, wherein the power generator comprises at least one battery operably connected to the compressor.

8. The pump system according to claim 6, wherein one of the one or several of photovoltaic panels, wind turbines, water turbines are arranged to charge at least one battery.

9. The pump system according to claim 1, further comprising a check valve in liquid communication with the liquid inlet of the pump housing.

10. The pump system according to claim 9, further comprising a filter unit arranged before the check valve relative to a direction of flow of the liquid.

11. The pump system according to claim 9, wherein the check valve comprises a generally tubular body provided with a number of passages, a generally tubular flexible membrane arranged coaxial with and inside the body having one end of the tubular membrane fixedly attached to the body.

12. The pump system according to claim 1, wherein the second passage is arranged with a second conduit of such a length as to ensure that its free end is above a liquid level when placed in the liquid.

13. The pump system according to claim 1, wherein the pressurized fluid is pressurized ambient air.

14. The pump system according to claim 1, further comprising a buoyancy element.

15. The pump system according to claim 1, further comprising anchoring rods adopted to be attached to a bottom surface of a water area.

16. The pump system according to claim 15, further comprising a third conduit attached to the liquid inlet, wherein the conduit and the third conduit are arranged as modules with fixed lengths that are inter-connectable.

17. A pump comprising:

a generally cylindrical pump housing, wherein the housing is arranged with a liquid inlet in one end and a liquid outlet in a second end;

a tubular flexible membrane arranged inside the pump housing;

a first passage arranged in a vicinity of the liquid inlet for introducing pressurized fluid between the tubular membrane and the housing;

a second passage arranged in a vicinity of the liquid outlet for releasing the pressurized fluid, wherein the tubular membrane has an elasticity providing a local radial compression and forming a ring-shaped fluid compartment when a pulse of pressurized fluid is entered through the first passage, wherein the ring-shaped fluid compartment is able to travel along the housing bringing a volume of liquid with it; and a check valve in liquid communication with the liquid inlet of the pump housing, wherein the check valve comprises a generally tubular body provided with a number of passages, a generally tubular flexible membrane arranged coaxial with and inside the body having one end of the tubular membrane fixedly attached to the body.

18. The pump according to claim 17, wherein the tubular flexible membrane is made of one of a rubber hose and plastic having the required properties and has a shape and dimension so as to contact at least a major part of a inner surface of the housing when placed inside the housing.

19. The pump according to claim 17, wherein the ends of the flexible membrane are attached to the housing at the liquid inlet and the liquid outlet by appropriate attachment elements.

20. The pump according to claim 17, wherein the first passage is connected to a pressure source and is situated closer to the liquid inlet than the second passage.

21. The pump according to claim 17, wherein the first passage and the second passage are preferably arranged on the same side of the pump housing when viewed in a circumferential direction, and each passage is arranged with suitable attachment elements.

22. The pump according to claim 17, wherein the pressurized fluid is pulsated pressurized ambient air.

* * * * *